United States Patent [19]

Walz et al.

[11] 4,295,852

[45] Oct. 20, 1981

[54] PROCESS FOR DYEING POLYAMIDE FIBRES

[75] Inventors: Klaus Walz, Leverkusen; Joachim Fiegel, Bergisch-Gladbach, both of Fed. Rep. of Germany

[73] Assignee: Bayer Aktiengesellschaft, Leverkusen, Fed. Rep. of Germany

[21] Appl. No.: 202,907

[22] Filed: Nov. 3, 1980

[30] Foreign Application Priority Data

Nov. 8, 1979 [DE] Fed. Rep. of Germany ..... 2945102

[51] Int. Cl.[3] ..... D06P 3/24

[52] U.S. Cl. ..... 8/560; 8/589; 8/680; 8/685; 8/924

[58] Field of Search ..... 8/560, 589, 680, 685, 8/924

[56] References Cited

U.S. PATENT DOCUMENTS

| | | | |
|---|---|---|---|
| 3,790,344 | 2/1974 | Frickenhaus et al. | 8/560 |
| 3,844,712 | 11/1974 | Frickenhaus et al. | 8/560 |
| 3,874,891 | 4/1975 | Grobmann et al. | 8/560 |
| 3,993,439 | 11/1976 | Duebel et al. | 8/560 |

*Primary Examiner*—A. Lionel Clingman

*Attorney, Agent, or Firm*—Sprung, Felfe, Horn, Lynch & Kramer

[57] ABSTRACT

Polyamide fibre materials are dyed with acid dyestuffs and/or metal complex dyestuffs in the presence of compounds of the formula

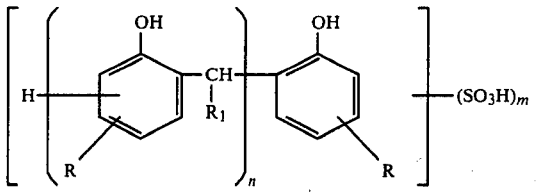

in which

R represents a $C_4$–$C_{12}$-alkyl, $C_1$–$C_{12}$-alkoxy, phenyl, cyclohexyl or $C_2$–$C_{10}$-hydroxyalkoxy radical, $R_1$ represents hydrogen or a $C_1$–$C_4$-alkyl radical, n represents an integer from 1 to 10 and m represents a number from 1 to n+1, or water-soluble salts thereof.

3 Claims, No Drawings

PROCESS FOR DYEING POLYAMIDE FIBRES

The present invention relates to a process for dyeing polyamide fibre materials with acid dyestuffs or metal complex dyestuffs, characterised in that the dyeing is carried out in the presence of compounds of the general formula

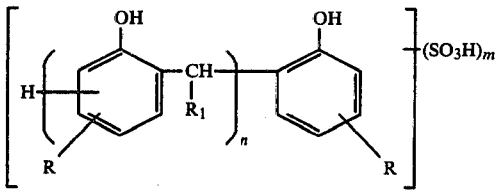

I or water-soluble salts thereof, wherein

R represents a $C_4$–$C_{12}$-alkyl, $C_1$–$C_{12}$-alkoxy, phenyl, cyclohexyl or $C_2$–$C_{10}$-hydroxyalkoxy radical, $R_1$ represents hydrogen or a $C_1$–$C_4$-alkyl radical, n represents an integer from 1 to 10 and m represents a number from 1 to n+1.

Examples of alkyl radicals R which may be mentioned are the tert.-butyl, octyl, nonyl and dodecyl radical and examples of alkoxy radicals which may be mentioned are the methoxy, ethoxy, propoxy, isopropoxy, butoxy and hexyloxy radical. Examples of suitable hydroxyalkoxy radicals are the 2-hydroxyethoxy radical, the 2-hydroxypropoxy radical, the 2-hydroxybutoxy radical and the 2-hydroxy-decyloxy radical.

The radical R can be in the o-, m- or p-position relative to the phenolic hydroxyl group. It is in the p-position in compounds which are preferably to be used. The methylene group is then bonded to the benzene ring in the o- and o'-position.

Examples of alkyl radicals $R_1$ which may be mentioned are the methyl, ethyl, propyl and isopropyl radical.

Salt-forming cations which can be used for the sulphonic acids of the formula I are alkaline earth metal ions, such as magnesium or calcium, or, preferably, monovalent cations, such as the ions of the alkali metal lithium, sodium or potassium, the ammonium ion or substituted ammonium ions, such as the ethylammonium ion, butylammonium ion, cyclohexylammonium ion, hydroxyethylammonium ion, bis-hydroxyethylammonium ion, tris-hydroxyethylammonium ion or bis-hydroxypropylammonium ion, or quaternary ammonium ions, such as the bis-hydroxyethyldimethylammonium ion or the trimethyl-cyclohexylammonium ion.

The compounds of the formula I can be prepared in a manner which is known per se, by reacting the corresponding phenols with formaldehyde or lower aldehydes, such as isobutyraldehyde, in the presence of acid catalysts, such as sulphuric acid, toluenesulphonic acid or boron fluoride. The molecular weight of the condensation products obtained, or the degree of polymerisation n, is essentially determined by the molar ratio of phenolic compound to aldehyde. The preparation of the condensation products is described, for example, in German Offenlegungsschrift No. 2,306,104. The sulphonation is carried out in a known manner using, for example, oleum, sulphur trioxide or chlorosulphonic acid, if appropriate in inert solvents. The sulphonation is described, for example, in German Offenlegungsschrift No. 1,090,966.

Preferred compounds for the dyeing process according to the invention are compounds of the formula I, or salts thereof, in which R represents an alkyl radical containing 4–12, in particular 8 or 9, carbon atoms or the cyclohexyl radical, $R_1$ represents hydrogen, n denotes a number from 2 to 5 and m represents 2 to 5. The compounds are preferably employed in the form of their salts with lithium, sodium, potassium, ammonium or ammonium which is substituted by hydroxyethyl or hydroxypropyl groups.

The polyamide materials can be dyed with metal complex dyestuffs and/or acid dyestuffs in the presence of the compounds I by a procedure in which the material to be dyed is introduced into an aqueous liquor which is warmed to 40°–50° C. and contains the metal complex dyestuffs and/or acid dyestuffs, the compounds of the formula I to be used according to the invention and acids, for example acetic acid, the temperature of the dyebath is then gradually increased to 100°–130° C. and this temperature is maintained until the dyebath is exhausted. It has proved particularly advantageous to pre-treat the material to be dyed with an aqueous liquor which contains only the compounds with sulphonic acid groups and acids at 40°–50° C. for a short time and only then to add the dyestuffs to the liquor at temperatures between 40° and 98° C., to then gradually increase the temperature of the dyebath to 100°–130° C. and to maintain the bath at this temperature until it is exhausted.

The amounts in which the compounds of the formula I are added to the dyebaths can vary within wide limits; they can easily be determined by preliminary experiments. In general, amounts of 0.5–3 percent by weight, relative to the weight of the material to be dyed, have proved suitable, depending on the desired depth of colour.

The dyeing process is suitable for natural polyamides, such as wool and silk, and in particular for dyeing synthetic polyamides, such as polycaprolactam, polyhexamethylenediamine adipate or poly-ω-aminoundecanoic acid, with 1:2 metal complex dyestuffs.

Suitable dyestuffs are described, for example, in the Colour Index, 3rd Edition (1971), Volume 1.

With the aid of the process according to the invention, it is possible to obtain outstandingly uniform dyeings on polyamide fibre materials in the most diverse forms of processing, for example as flocks, slubbings, texturised filaments, tow, yarn, woven fabric, knitted fabric or fleeces, with metal complex dyestuffs and/or acid dyestuffs; in particular, the streaky dyeing which readily occurs during dyeing of woven fabrics or knitted fabrics of synthetic polyamides is avoided.

The parts given in the following examples are parts by weight.

EXAMPLE 1

Polyamide knitted goods of filament-yarn are introduced, in a liquor ratio of 1:15, into a bath which has been warmed to 40° C., has been adjusted to a pH value of 8 with a mixture of monosodium hydrogen phosphate and tetrasodium pyrophosphate and contains, per liter, 0.24 g of the compound described below. The material is treated in this bath whilst warming to 98°–115° C., and 0.4 g per liter of the 1:2 chromium complex of

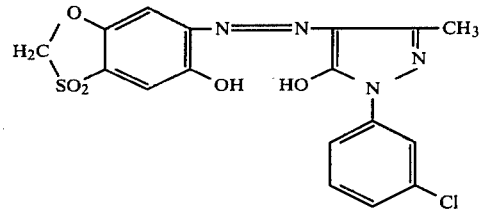

is then added.

After a dyeing time of 60–120 minutes at 98° C., the liquor is exhausted. A very level Bordeaux dyeing results. Very level blue dyeings are obtained if the chromium complex is replaced by the same amount of the dyestuff of German Auslegeschrift No. 1,644,600, Example 1, of German Auslegeschrift No. 1,932,647, Example 1A, or of German Offenlegungsschrift No. 2,508,506.

The compound used was prepared in the following manner:

332 parts of 36% strength aqueous formaldehyde solution are added to 1,320 parts of nonylphenol and 1 part of concentrated sulphuric acid at 90°–100° C. in the course of 1–2 hours. The mixture is subsequently stirred at 90°–100° C. for 2 hours and the water is then distilled off in vacuo. The resin obtained (molecular weight: 700) is taken up in 1,000 parts of cyclohexane, and 650 parts of chlorosulphonic acid are slowly added at 10°–20° C. The mixture is stirred at room temperature for 20 hours and then neutralised by adding 650 parts of 45% strength sodium hydroxide solution. The cyclohexane and the water are then distilled off in a rotary evaporator. About 2,000 parts of a resin which, after cooling, can be powdered to give a water-soluble product are obtained.

EXAMPLE 2

The dyeing procedure described in Example 1 is carried out in the same manner. However, 0.24 part of the condensation product described below are added instead of the compound added in Example 1. An outstandingly level Bordeaux dyeing likewise results. The condensation product employed was prepared as follows: 264 parts of p-cyclohexylphenol and 1 part of concentrated sulphuric acid are mixed with 300 parts of xylene, and 82 parts of 36.5% strength aqueous formaldehyde are slowly added at 100°–110° C. At the same time, the water is distilled off via a water separator. The xylene is distilled off in vacuo, the resin obtained (molecular weight: 600) is dissolved in 500 parts of trichloroethylene, and 130 parts of chorosulphonic acid are slowly added at 10°–20° C. The mixture is subsequently stirred at room temperature for 12 hours and at 50° C. for 30 minutes and is neutralised, at 20°–40° C., with 130 parts of 45% strength sodium hydroxide solution. Concentration in vacuo gives about 410 parts of a viscous resin which, after cooling, can be powdered to give a water-soluble, white product.

The dyeing procedure can be carried out equally successfully if, instead of the condensation product mentioned, a condensation product prepared in the same manner from 225 parts of p-tert.-butylphenol, 32 parts of 36.5% strength formaldehyde, 1 g of concentrated sulphuric acid (molecular weight: 500), 114 parts of chlorosulphonic acid and 86 parts of 25% strength aqueous ammonia is used.

EXAMPLE 3

A knitted fabric of ε-polycaprolactam is introduced, in a liquor ratio of 1:40, into a bath which has been warmed to 50° C., has been adjusted to a pH value of 8 with trisodium phosphate and contains, per liter, 0.3 g of the condensation product described below. The material is treated in the bath, whilst warming to 98° C., and 0.125 g per liter of the 1:2 chromium complex of

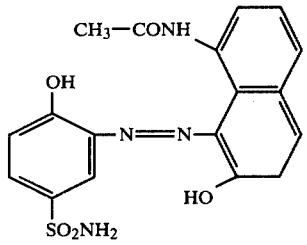

is then added. After dyeing at 98° C. for about ninety minutes, the liquor is exhausted. A light grey, outstandingly uniform dyeing is obtained.

The condensation product used is prepared in the manner described in Example 1, from 330 parts of nonylphenol, 94 parts of 37% strength formaldehyde solution, 1 part of concentrated sulphuric acid (molecular weight: 1,150), 330 parts of cyclohexane and 166.5 parts of chlorosulphonic acid. 200 parts of triethanolamine were used for the neutralisation instead of sodium hydroxide solution.

We claim:

1. Process for dyeing polyamide fibre materials with acid dyestuffs and/or metal complex dyestuffs, characterised in that the dyeing is carried out in the presence of compounds of the formula

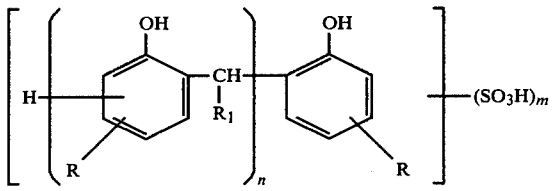

in which

R represents a $C_4$–$C_{12}$-alkyl, $C_1$–$C_{12}$-alkoxy, phenyl, cyclohexyl or $C_2$–$C_{10}$-hydroxyalkoxy radical, $R_1$ represents hydrogen or a $C_1$–$C_4$-alkyl radical, n represents an integer from 1 to 10 and m represents a number from 1 to n+1, or water-soluble salts thereof.

2. Process according to claim 1, characterised in that compounds of claim 1 in which R represents a $C_4$–$C_{12}$-alkyl radical or the cyclohexyl radical, $R_1$ represents hydrogen and n and m represent numbers from 2 to 5 are used.

3. Process according to claim 1, characterised in that fibre materials of synthetic polyamides are dyed with 1:2 metal complex dyestuffs.

* * * * *